US006073376A

United States Patent [19]

Verret

[11] Patent Number: 6,073,376

[45] Date of Patent: Jun. 13, 2000

[54] EDGING FOR SIGN CASING

[76] Inventor: Normand Verret, 745 Rue Canada, Edmundston, Newbrunswick, Canada, E3V 1W3

[21] Appl. No.: 09/138,541

[22] Filed: Aug. 24, 1998

[51] Int. Cl.[7] ..... G09F 17/00

[52] U.S. Cl. ..... 40/603; 160/378

[58] Field of Search ..... 40/603; 160/327, 160/328, 378

[56] References Cited

U.S. PATENT DOCUMENTS

| | | | |
|---|---|---|---|
| 3,220,469 | 11/1965 | Oehmig . | |
| 4,554,754 | 11/1985 | Stilling | 40/603 |
| 4,771,559 | 9/1988 | Keithley | 40/603 |
| 4,817,317 | 4/1989 | Kovalak, Jr. | 40/603 |
| 4,899,797 | 2/1990 | Green . | |
| 4,937,961 | 7/1990 | Gandy et al. | 40/603 |
| 5,020,254 | 6/1991 | Sheppard | 40/603 |
| 5,033,216 | 7/1991 | Gandy et al. | 40/603 |
| 5,255,459 | 10/1993 | Verret . | |
| 5,301,447 | 4/1994 | Lotter et al. . | |
| 5,647,155 | 7/1997 | Hillstrom . | |
| 5,669,166 | 9/1997 | Verret . | |

FOREIGN PATENT DOCUMENTS

| | | |
|---|---|---|
| 2201024 | 8/1988 | United Kingdom . |

*Primary Examiner*—Joanne Silbermann
*Attorney, Agent, or Firm*—Mario D. Theriault

[57] ABSTRACT

A sign casing having a structural frame defining a front plane and a planar opening in that front plane. The structural frame has a cleft extending around the front plane. The cleft has a depth dimension extending in a direction substantially parallel to the front plane, and a latching member mounted therein. The sign casing also includes an edging bordering the planar opening. The edging has a flat strip for covering an edge of the planar opening and a latch blade extending perpendicularly from the flat strip. The latch blade has a longitudinal bulge thereon which is engagedly mountable in the latching member of the cleft such that the edging is mountable to the structural frame by simply pushing the blade into the cleft.

14 Claims, 4 Drawing Sheets

EDGING FOR SIGN CASING

FIELD OF THE INVENTION

This invention pertains to sign edging and more particularly, it pertains to sign edging that clips in place on a perimeter of a sign casing in a single movement.

BACKGROUND OF THE INVENTION

Flexible face signs of the type related to the present invention have their face material stretched across an opening in a sign frame and anchored to the periphery of the sign's opening. Holding devices are attached at intervals along the face material and are generally made to engage into a slot along the sign frame or casing to affix the face material to the casing. The holding devices and the slot are covered with a cap or molding that enhances the general appearance of the sign. These corner caps or moldings, hereinafter referred to as sign edging, are commonly held to the sign flame with screws, or by an interlocking engagement of mating lips and grooves.

Examples of sign edging of the prior art are disclosed in U.S. Pat. No. 5,255,459 issued on Oct. 26, 1993, and in U.S. Pat. No. 5,669,166, issued on Sep. 23, 1997, both to Normand Verret, the inventor of the present invention. In these inventions, the edging clips in place over a sign frame and is held there by the interference of two pairs of opposing lips.

Various other types of sign edging are known in the art, and for reference purposes, other examples of sign edging of the prior art are disclosed in U.S. Pat. No. 5,301,447 issued on Apr. 12, 1994 to H. R. Lotter et al, and in U.S. Pat. No. 5,647,155 issued on Jul. 15, 1997 to D. U. Hillstrom.

In both the latter-mentioned structures, it is believed that the sign edging must be deformed slightly to engage onto retaining lips on the sign casing. The installation requires applying pressure from two directions in order to clip the edging in place. A sign edging of the prior art is typically installed by pushing or pulling it in a direction perpendicular to the sign face, and by simultaneously twisting or pressing it in a direction tangential to the sign face.

These movements are not always readily understood by tradespeople. These movements require some training which is not always available to the one-time subcontractor installing a sign of that type, or to the maintenance person tending to the sign therafter. As a result, the edging is often improperly removed causing damage to the engaging lips, or is not properly re-installed, leading to premature deterioration of the sign.

SUMMARY OF THE INVENTION

In the present invention, however, there is provided a sign edging that has a structure which allows its installation and removal from a sign casing in a single motion. This motion is readily understandable by tradespeople, and virtually eliminates all possibilities of improperly removing or re-installing the edging from or on a sign casing.

In one aspect of the present invention, there is provided a sign casing comprising a structural frame defining a front plane and a planar opening in that front plane. The structural frame has a cleft extending around the front plane. The cleft has a depth dimension extending in a direction substantially parallel to the front plane. The cleft has latching member mounted therein. The sign casing also comprises an edging bordering the planar opening. The edging comprises a flat strip for covering an edge of the planar opening and a latch blade extending perpendicularly from the flat strip. The latch blade has a longitudinal bulge thereon which is engagedly mountable in the latching member of the cleft such that the edging is mountable to the structural frame by simply pushing the blade into the cleft.

The installation of the edging over a structural frame of a sign does not require any tool or elaborate instruction. The mounting of the edging on the sign casing is effected by aligning the blade into the cleft and by manually pressing the edging against the sign frame to force the bulge on the blade into the latching member in the cleft. A procedure for installing the edging of the present invention is understandable in a glance and generally, written installation instructions are not required.

In another aspect of the present invention the structural frame has a longitudinal cavity therein and a longitudinal gap leading to the cavity. The cleft is mounted inside the cavity. The edging comprises a guide lip spaced apart from the latch blade at a distance which is substantially similar to a width of the gap. The guide lip is usable for guiding the blade into the cavity. Hence, the edging of the present invention is installable in all types of weather when tradespeople must wear gloves or mitts for example, or at dusk when the visibility is somewhat reduced. A proper alignment of the blade is guided by the guide lip. The guide lip is also useful for preventing loosening of the latched connection between the latch blade and the cleft, during periods of high winds for example, where the face material of the sign may flap in and out excessively.

In a further aspect of the present invention, the edging of the sign casing of the present invention comprises a portion extending at substantially right angle with the flat strip and over the front plane of the sign. This portion has a flat surface or a convex or compound curvature, and may comprise decorative raised patterns thereon. The edging of the present invention is thereby usable for enhancing the visual aspects of a sign.

The sign edging of the present invention is simple to manufacture and provides a strong hold to the sign casing. The sign edging is adaptable to most signs having their face materials held by gripping devices mounted in serrated slots in a sign casing.

BRIEF DESCRIPTION OF THE DRAWINGS

The preferred embodiment of the invention will be further understood from the following description, with reference to the drawings in which.

DETAILED DESCRIPTION OF THE PREFERRED EMBODIMENT

Figure 1:
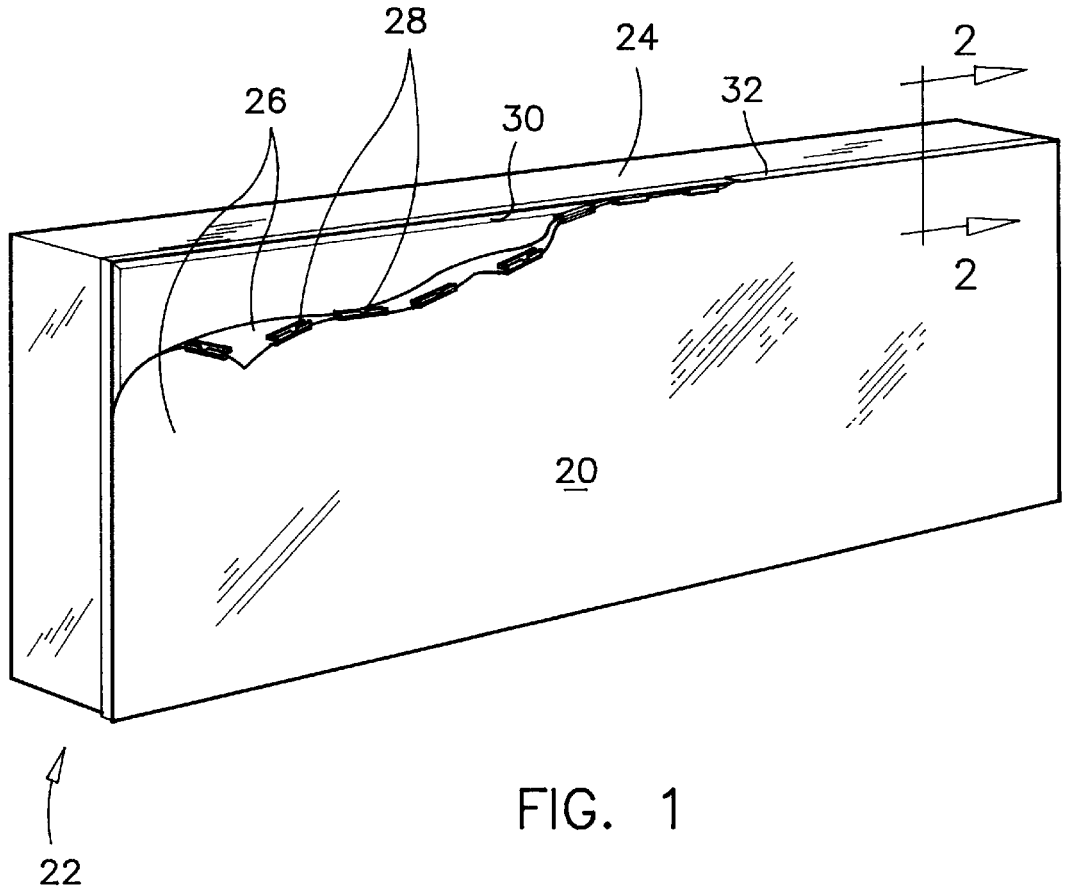
FIG. 1 illustrates a rectangular sign of the type related to the present invention.

The sign casing of the preferred embodiment is a full face sign wherein the non-illuminated portion thereof is limited to a very narrow strip bordering the sign face. This type of sign casing is referred to in the sign industry as having a frameless sign face. The frame surrounding the sign face is referred to in the trade as a frameless extruded member, or a frameless extrusion and is generally made of aluminium.

The edging of the sign casing of the preferred embodiment is also generally made of aluminium and is illustrated in the accompanying drawings and in particular in FIGS. 1 to 7. It will be appreciated by those knowledgeable in the art that several types of plastic materials may also be appropriate for manufacturing the extruded members and the sign edging described herein. As mentioned above, the sign casing has a frameless sign face 20, a light source (not shown), a framing structure 22 defining a sign opening, frameless extruded members 24 bordering the sign opening and a flexible face material 26 stretched across the opening of the sign by means of a plurality of flex holders 28 engaged within a slot 30 in the extruded members 24 around the sign face.

Figure 2:
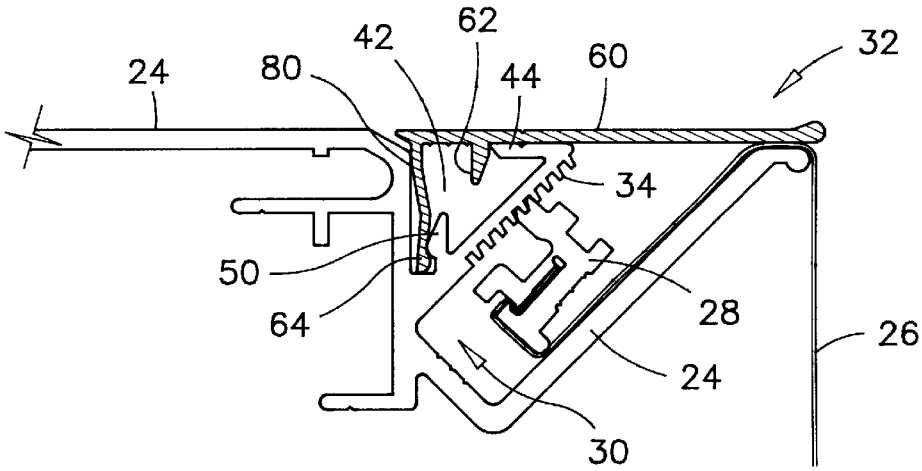
FIG. 2 is a partial cross-section of the extruded member as viewed along line 2—2 in FIG. 1, and illustrating the installation of a sign edging of a first type.

The framing of an edge of the sign casing of the preferred embodiment, as illustrated in FIG. 2, comprises the frameless extruded member 24 and a sign edging 32. The slot 30 in the extruded member 24 has a rectangular cross-section and extends lengthwise along the extruded member 24. The longer cross-section dimension of the slot 30 makes an acute angle with the face material 26. The slot 30 has serration 34 on an inside wall thereof, for retaining several flex holders 28 in a manner which is described in the U.S. Pat. No. 5,255,459 issued on Oct. 26, 1993 to the inventor of the instant patent application.

The extruded member 24 has a longitudinal gap 40 there-along. The longitudinal gap 40 has a transversal dimension of a first extent identified as label "A" in FIG. 5. The gap 40 leads into a longitudinal cavity 42 adjacent the serrated wall 34 of slot 30.

The gap 40 has on a first side thereof nearest to the sign face, a first lip 44 having a sharp edge and extending perpendicularly backward relative to the sign face along an outside surface of the extruded member 24. The first lip 44 extends parallel to a reference outside surface 'C' of the extruded member 24 at a distance 'D' toward the inside region of the sign casing relative to the reference surface 'C'. On the opposite side of the first lip 44 the gap 40 is defined by a straight wall 46 extending parallel to the sign face. The first lip 44, the straight wall 46 and the backside of the serrated wall 34 define the longitudinal cavity 42 communicating with the gap 40.

A longitudinal ledge 50 extends from the bottom region of the cavity 42 in a direction substantially parallel to the straight wall 46, near the straight wall. The ledge 50 has an enlarged arrow-like portion 52 along the vertex thereof, defining with the straight wall 46 a cleavage having a taper opening and a tight gap contiguous with the taper opening. The cleavage defined by the ledge 50, the enlarged arrow-like portion 52 and the straight wall 46 are hereinafter referred to as the lock cleft 54.

The edging 32 has a straight portion 60 for covering the gap 40 and the slot 30. The thickness of the straight portion 60 is substantially the same as the distance 'D' between a projection of the first lip 44 and a projection of the reference outside surface 'C' of the extruded member 24. Therefore, when the edging 32 is installed on the extruded member, the entire width of the outside surface of the sign casing is flat.

The straight portion 60 has on a rear region thereof relative to the sign casing, a guide lip 62 and a latch blade 64, both extending at right angle with the straight portion 60 toward an inside surface of the edging 32 relative to a mounting of the edging on a sign casing. The guide lip 62 and latch blade 64 are spaced apart a distance 'B' which is substantially the same as the width 'A' of gap 40.

The guide lip 62 has a pointed tip and a straight edge 66 along a base portion thereof and which is perpendicular to the straight portion 60. The guide lip 62 is adapted to slide against the edge of the first lip 44 as illustrated in FIG. 2, in order to guide the latch blade 64 into the lock cleft 54.

The latch blade 64 is longer than the guide lip 62. The latch blade 64 has a longitudinal bulge 68 on an end there of and an appropriate length such that the bulge 68 can be inserted into the lock cleft 54. The thickness of the bulge 68 is substantially the same as the tight gap in the lock cleft 54, such that the longitudinal bulge 68 is movable into the lock cleft 54 and is retainable inside the lock cleft 54 by the enlarged arrow-like portion 52 of the ledge 50.

The latch blade 64 is slightly curved forwardly as illustrated in FIGS. 2–4, 6 and 7. The latch blade 64 is relatively thin and resiliently flexible in a rearward direction relative to the sign f ace such that the longitudinal bulge 68 is slidable into the lock cleft 54 over the arrow-like taper portion 52, to form an interfering engagement with the enlarged portion 52 and to enhance a locking connection into the lock cleft 54. The longitudinal bulge 68 and the arrow-like portion 52 have rounded edges such that the latch blade 64 is slidable into the lock cleft 54 in a smooth latching motion, and is seized therein by the resiliency of the ledge 50 and of the latch blade 64 acting against one-another. The interference between the longitudinal bulge 68 and the arrow-like enlarged portion 52, and the interference of the shoulder 66 with the sharp edge of the guide lip 44 cooperate for retaining the edging 32 to the extruded member 24.

Figure 3:
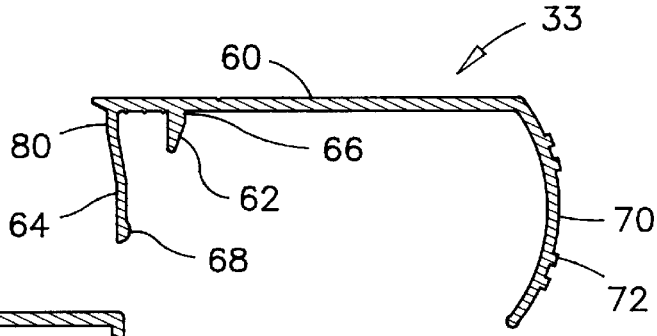
FIG. 3 is a cross-section of a sign edging of a second type.
Figure 4:
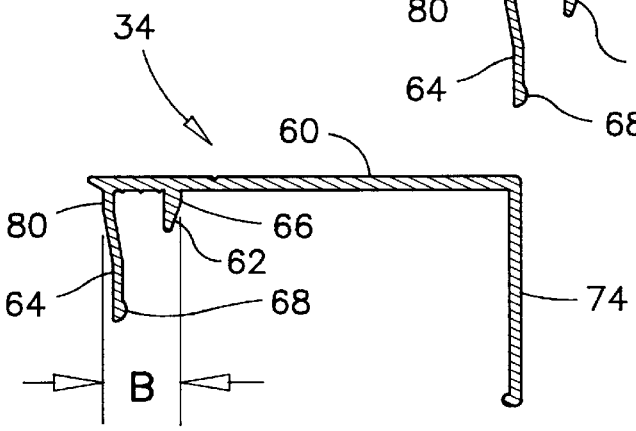
FIG. 4 is a cross-section of a sign edging of a third type.
Figure 5:
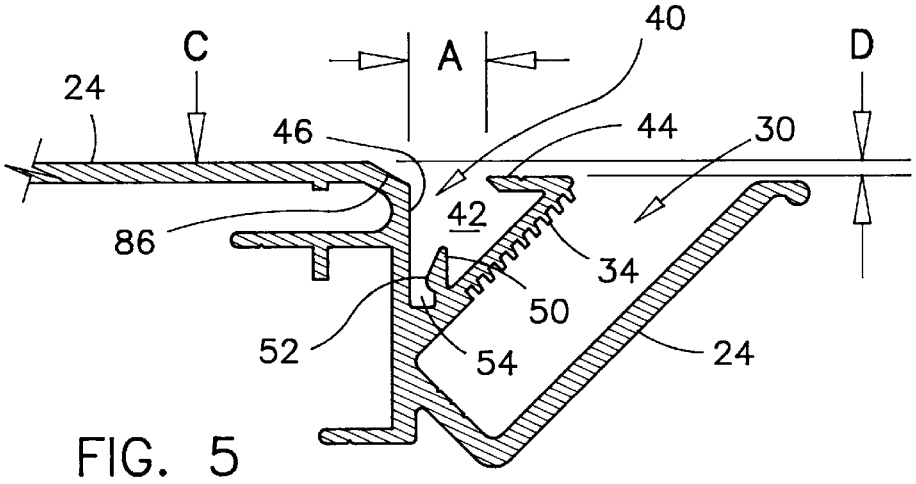
FIG. 5 is a partial cross-section of an extruded member used for framing a sign of the type shown in FIG. 1 and FIG. 2.

Referring now to FIGS. 3 and 4, the edging of the sign casing of the preferred embodiment may have several shapes to vary the appearance of signs manufactured therewith. For examples, the edging 33 in FIG. 3 has a straight portion 60 and a curved portion 70 extending from the straight portion 60. The curved portion 70 is convex in shape and may have decorative ridges or raised patterns 72 therealong for enhancing the appearance of the sign having such edging mounted thereon.

The edging 34 illustrated in FIG. 4 also has a straight portion 60 and a flat edge 74 making a right angle with the straight portion 60. The flat edge 74 is normally used to promote an appearance of strength and durability of a sign by suggesting the presence of a wide frame along the perimeter of the sign face.

Figure 6:
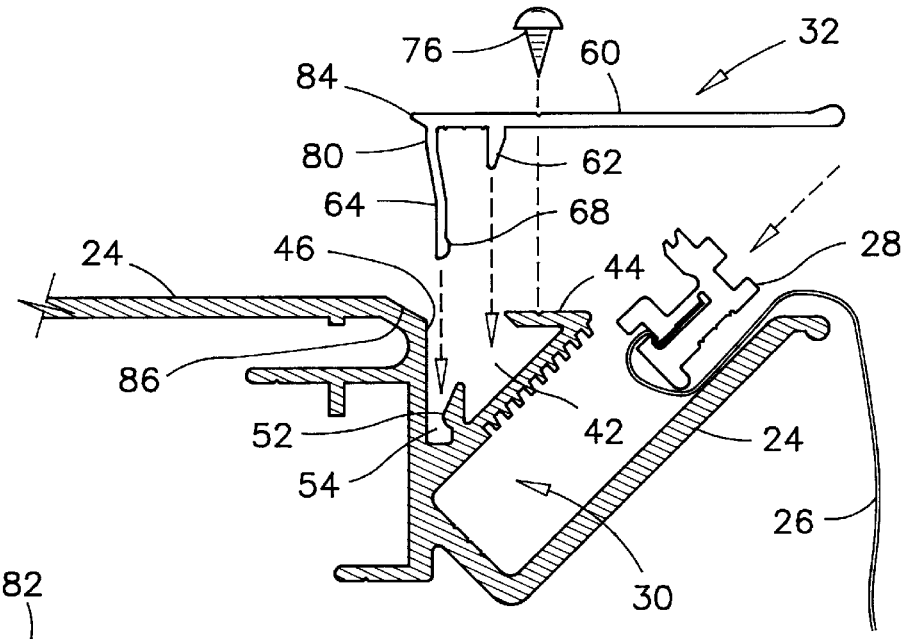
FIG. 6 illustrates an installation of a flex holder in the slot of an extruded member and an installation of a sign edging of a first type to this extruded member.
Figure 7:
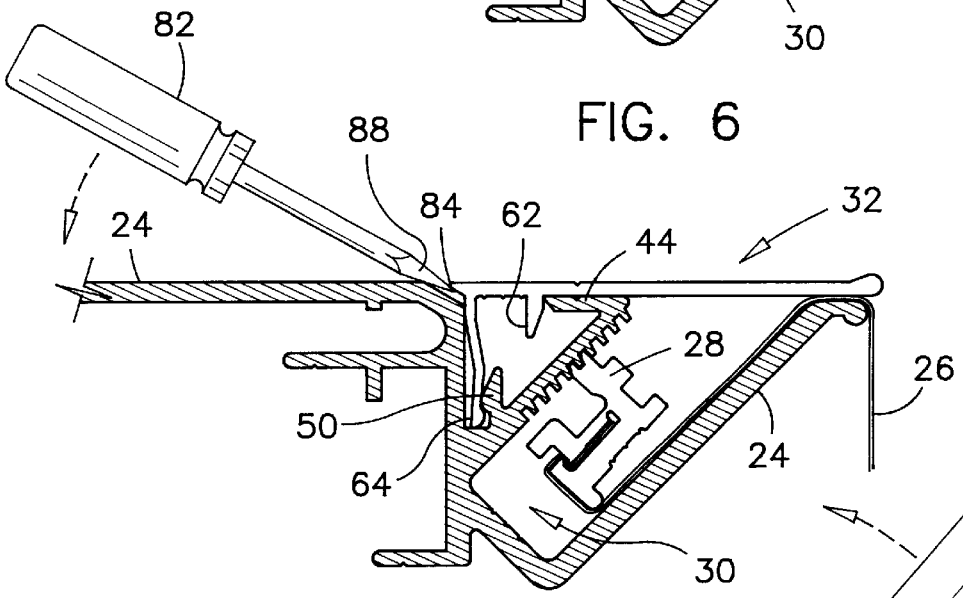
FIG. 7 illustrates a preferred method for removing a sign edging from an extruded member.

Referring specifically to FIGS. 2, 6 and 7, and according to the previous teachings in the present disclosure, the edging 32,33 or 34 is attachable to the extruded member 24 without fasteners. However, the width of the first lip 44 is sufficient for overlapping the straight portion 60 of the edging and allowing the optional installation of screws 76 in few places along the sign casing for positively fastening the edging to the extruded member 24. The provision of screws 76 through the edging is recommended only for sign installations in regions of high winds, or where one wishes to prevent vandals from removing the edging 32,33 or 34 from the sign casing and damaging the sign. Otherwise, the edging 32,33 or 34 is simply pushed into the gap 40 as illustrated in FIG. 6, and locked in place by the engagement of the guide lip 62 and latch blade 64 with the structure of the cavity 42. The positive engagement of the edging 32,33 or 34 with the extruded member 24 is resistant against most conditions encountered by an installed sign.

A clockwise twisting of the edging strip 32 when looking at FIGS. 2 and 7 for example, is prevented by the engagement of the guide lip 62 with the first lip 44 and by the contact of the front edge of the edging 32 against the front edge of the extruded member 24. Similarly, a counterclockwise twisting of the edging 32 when looking at FIG. 2, is prevented by the engagement of the first and guide lips 44,62 and by the contact of the base portion 80 of the latch blade 64 against the outer portion of the straight wall 46.

The removal of the edging 32,33 or 34 from the extruded member 24 is effected by prying it out of the cavity 42 with a screwdriver 82, or other flat tools, as illustrated in FIG. 7. The edging 32,33 or 34 has a longitudinal crest 84 connected to the straight portion 60 and extending lengthwise and rearward relative to the sign face. The removal of the edging 32,33 or 34 is effected by inserting the blade 88 of the screwdriver 82 under the longitudinal crest 84 and prying the blade against the extruded member 24 as illustrated in FIG. 7. For this purpose, the straight wall 46 is shorter than the length of the latch blade 64, and forms a generous chamfer 86 with the outside surface of the extruded member 24. A screwdriver blade 88 is thereby easily inserted under the crest 84 of the edging when the edging 32,33 or 34 is mounted to the extruded member 24.

Figure 8:
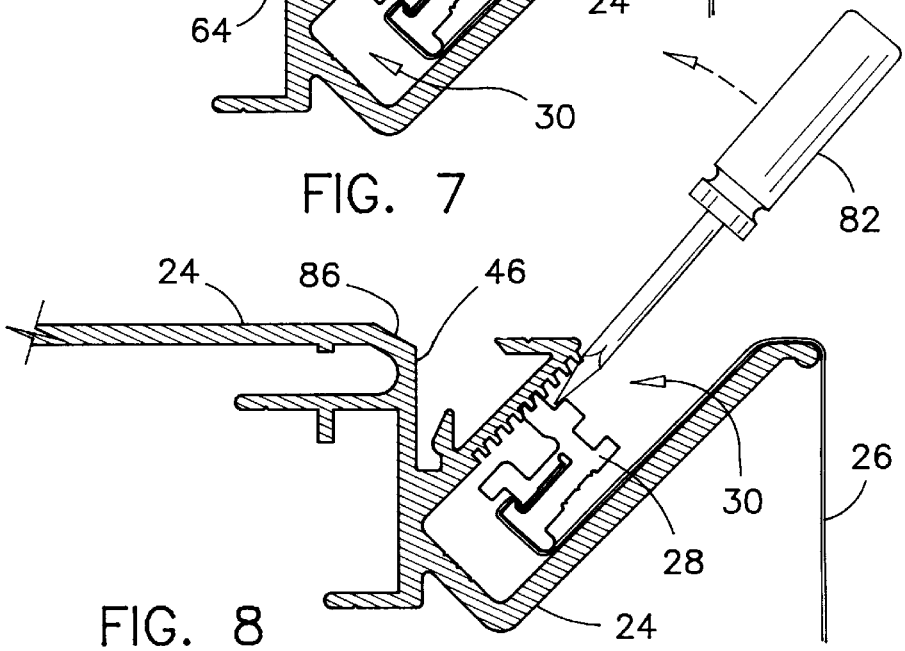
FIG. 8 illustrates a preferred method for removing a flex holder from the serrated slot of an extruded member.

When the edging 32,33 or 34 is removed from the extruded member 24, the slot 30 of the extruded member 24 is accessible for inserting a flex holder 28 therein as illustrated in FIG. 6, or for removing a flex holder 28 out of the lot 30 using a screwdriver 82, as illustrated in FIG. 8.

Figure 9:
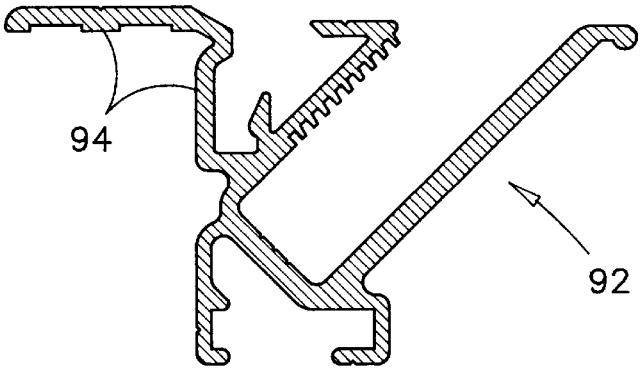
FIG. 9 is a cross-section view of a retrofit extruded member used for installing a sign casing of the type related to the present invention to an existing structure.
Figure 10:
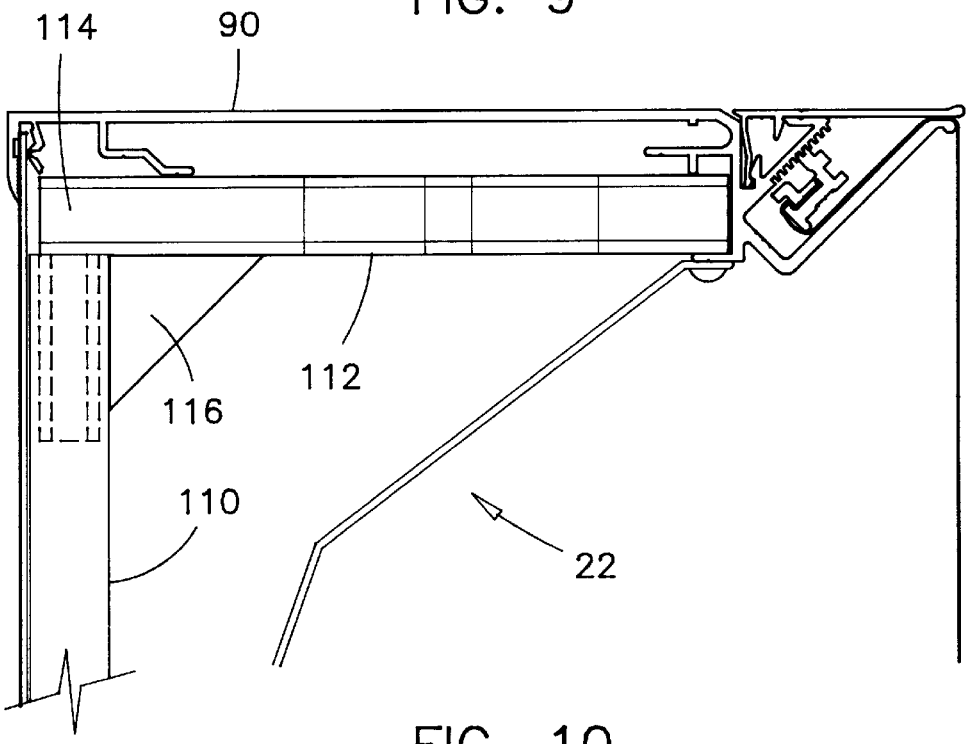
FIG. 10 is a partial cross-section of a sign casing of the type illustrated in FIG. 1, showing a portion of a C-frame used for retaining opposing extruded members in a fixed spaced-apart relationship with one-another.

It will be appreciated by the person knowledgeable in the art that the extruded member 24 may be an integral part of a side member 90 of the sign casing as illustrated in FIG. 10, or it could be manufactured as a modular retrofit structural member 92 having a right-angled portion 94 as illustrated in FIG. 9. The modular retrofit version 92 is particularly advantageous for installing a frameless sign face on an existing structure for example by securing the tight angle portion 94 to the existing structure.

Figure 11:
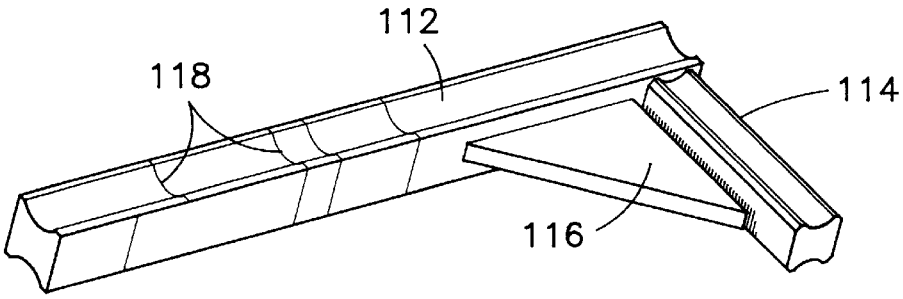
FIG. 11 is a perspective view of an arm member used for stiffening the structure illustrated in FIG. 10.

Referring now to FIGS. 10 and 11, the structure 22 of the sign casing of the preferred embodiment comprises a plurality of C-shaped members each having a stem member 110 and two arm members 112. The arm members 112 are pointing forwardly relative to the sign casing, at right angle from the stem member, one at each en d of the stem member 110. The stem member 110 is preferably made with structural steel or aluminium tubing. The arm members 112 are preferably made of cast aluminium. The arm members 112 are preferably joined to the stem member 110 by means of a right angle peg 114 which extends from each arm member 112 and which is sized to tightly fit inside the structural tubing of the stem member 110. A gusset 116 is preferably provided on the arm member 112 to act against the stem member 110 for reinforcing a joint between the arm member 112 and the stem member 110. Parting lines 118 are further provided on the arm members 112 for selectively cutting the arm members 112 to match various nominal widths of extruded members 90. The structure 22 of the sign casing of the preferred embodiment is particularly advantageous for shipping complete signs to customers in a compact kit form, and for easily erecting sign casings on a job site.

While the above description provides a full and complete disclosure of the preferred embodiment of this invention, various modifications, alternate constructions and equivalent may be employed without departing from the true spirit and scope of the invention. Such changes might involve alternate components, structural arrangements, operable features or the like. Therefore, the above description and accompanying illustrations should not be construed as limiting the scope of the invention which is defined by the appended claims.

I claim:

1. A sign casing comprising:

a structural frame defining a front plane and an opening in said front plane, said structural frame having a cleft extending around said front plane, said cleft having a depth dimension extending in a direction substantially parallel to said front plane and bulge sliding and seizing means formed therein; and edging means bordering said front plane, said edging means comprising a flat strip for covering an edge of said front plane and a blade extending perpendicularly from said flat strip; said blade having a bulge along a tip thereof, and said bulge being restrainably mountable in said bulge sliding and seizing means;

such that said edging means is mountable to said structural frame without conventional fasteners, by pushing and latching said blade into said cleft.

2. The sign casing as claimed in claim 1, further comprising a flex face material stretched across said opening and a plurality of flex holders affixed to a border of said flex face material; said structural frame comprising an elongated rectangular slot having a longer side making an acute angle with said front plane, and said flex holders being anchored in said slot.

3. The sign casing as claimed in claim 2, wherein said flat strip of said edging means extends over said slot for covering said slot and said flex holders.

4. The sign casing as claimed in claim 3 wherein said edging means comprises a portion contiguous with said flat strip and extending over said front plane.

5. The sign casing as claimed in claim 4, wherein said portion has a flat surface.

6. The sign casing as claimed in claim 4 wherein said portion is a curved portion having a convex curvature.

7. The sign casing as claimed in claim 6 wherein said curved portion has decorative raised patterns thereon.

8. The sign casing as claimed in claim 1 wherein said bulge sliding and seizing means comprises a ledge and a straight wall; said ledge being spaced apart from and parallel with said straight wall and having an arrow-like portion on an end thereof projecting toward said straight wall.

9. The sign casing as claimed in claim 8, wherein said arrow-like portion and said bulge have rounded edges.

10. The sign casing as claimed in claim 8, wherein said structural frame has an outside surface and said straight wall of said cleft forms a chamfer with said outside surface, and said edging means further comprises a longitudinal crest extending along said flat strip, and said longitudinal crest is mountable over said chamfer.

11. The sign casing as claimed in claim 1, wherein said edging means comprises a guide lip spaced apart from said blade, and said guide lip is engagedly mountable in said cleft against an edge of said cleft.

12. The sign casing as claimed in claim 1, wherein said blade is curved and is made of a resilient material.

13. The sign casing as claimed in claim 1, wherein said structural frame and said edging means are made of aluminium.

14. The sign casing as claimed in claim 1, wherein said structural frame comprises a right angled portion for retrofit attachment thereof to a separate sign frame.

* * * * *